US006530571B1

(12) United States Patent
McWilliams

(10) Patent No.: US 6,530,571 B1
(45) Date of Patent: Mar. 11, 2003

(54) BOARD GAME AND METHOD OF PLAYING

(76) Inventor: Patricia McWilliams, 308 Easton Rd., Riegelsville, PA (US) 18055

( * ) Notice: Subject to any disclaimer, the term of this patent is extended or adjusted under 35 U.S.C. 154(b) by 0 days.

(21) Appl. No.: 09/571,910

(22) Filed: May 16, 2000

(51) Int. Cl.[7] ..... A63F 3/00

(52) U.S. Cl. ..... 273/244.2; 273/259; 273/277; 273/430

(58) Field of Search ..... 273/236, 243, 273/244.1, 244.2, 259, 277, 429–432

(56) References Cited

U.S. PATENT DOCUMENTS

| | | | | |
|---|---|---|---|---|
| 1,741,596 | A | * | 12/1929 | Wright |
| 2,886,319 | A | | 5/1959 | Henderson ..... 273/93 |
| 4,000,897 | A | * | 1/1977 | York |
| 4,016,939 | A | | 4/1977 | Thron ..... 273/134 |
| 4,029,320 | A | * | 6/1977 | Hausman |
| 4,090,717 | A | * | 5/1978 | Rossetti |
| 4,121,823 | A | | 10/1978 | McBride ..... 273/249 |
| 4,261,569 | A | * | 4/1981 | Frohlich ..... 273/244.2 |
| 4,327,914 | A | * | 5/1982 | Dowell ..... 273/244.2 |
| 4,378,115 | A | * | 3/1983 | Terrero ..... 273/244.2 |
| 4,378,941 | A | | 4/1983 | Derby ..... 273/273 |
| 4,653,755 | A | * | 3/1987 | Panella et al. ..... 273/244.1 |
| 4,776,593 | A | * | 10/1988 | DiPersio et al. ..... 273/244.2 |
| 4,856,780 | A | * | 8/1989 | Begley |
| 4,921,251 | A | | 5/1990 | Kanenwisher ..... 273/93 |
| 5,123,653 | A | | 6/1992 | Murphy et al. ..... 273/244 |
| 5,248,147 | A | | 9/1993 | Smith ..... 273/244 |
| 5,407,204 | A | | 4/1995 | Meyer, III ..... 273/244 |
| 5,415,412 | A | | 5/1995 | McMahon ..... 273/244 |
| 5,435,554 | A | * | 7/1995 | Lipson |
| 5,497,999 | A | | 3/1996 | Stewart et al. ..... 273/298 |
| 5,513,848 | A | | 5/1996 | Keener ..... 273/244 |
| 5,516,290 | A | | 5/1996 | Quigley et al. ..... 434/129 |
| 5,746,431 | A | * | 5/1998 | McIntyre et al. ..... 273/247 |
| 5,762,337 | A | | 6/1998 | Poisson ..... 273/244.2 |
| 5,884,914 | A | * | 3/1999 | Lillen ..... 273/244.1 |
| 5,901,956 | A | * | 5/1999 | Warmack ..... 273/244 |
| 6,267,376 | B1 | * | 7/2001 | Jenkins |

OTHER PUBLICATIONS

Advertisement for game entitled "Rules of the Game," available at the Internet address *http://www.rulesofthegame.net/seegame.htm.*

* cited by examiner

*Primary Examiner*—Benjamin H. Layno
*Assistant Examiner*—Vishu K Mendiratta
(74) *Attorney, Agent, or Firm*—Charles A. Wilkinson; Clinton H. Wilkinson

(57) ABSTRACT

A game board having a representation of a baseball playing field is provided. Cards containing questions about the sport are divided into regular question and "challenge" question cards. When batting, a player uses a chance determining device to determine the outcome of an at bat, preferably either a "hit" or "out". If the outcome is a "hit", such player is then asked a question taken from a regular question card. If answered correctly, a playing piece is moved to the designated base. If the "hit" is a home run, a run is tallied on the scoreboard. Next, at the battling player's option, he or she may then ask an opposing player a question from a "challenge" question card. If the opposing player answers incorrectly, the battling player will advance his or her playing piece an extra base. The team with most runs at the end is declared the winner.

9 Claims, 5 Drawing Sheets

BOARD GAME AND METHOD OF PLAYING

BACKGROUND OF THE INVENTION

1. Field of the Invention

This invention relates to board games, and more particularly, to a board game that realistically portrays and imitates typical player movements and situations that might occur during actual play of such game or activity, for both the education and entertainment of those playing the game.

2. Preliminary Discussion

Despite the increased popularity of electronic video and computer games, board games, which have been played for thousands of years in all parts of the world, remain a popular form of competitive amusement for both children and adults. Today's board games may be classified into several broad categories. Games such as chess and checkers are of a type that generally divide the game board into a series of squares, and game pieces are moved from square to square as dictated by the rules of the game without necessarily having to follow a particular pathway or route. There are also a wide variety of "pathway-type" board games wherein the game pieces are moved sequentially along a standardized play path, usually consisting of a sequence of blocks or spaces having at least a beginning space and an ending space, as in monopoly. Finally, there are board games which attempt to simulate or mimic a particular sport or activity such as baseball and football. Countless variations and combinations of such types of board games are known in the prior art, many of which employ some form of chance-determining means, such as one or more die, a spinner having numerals thereon, or "chance" cards, for determining the movement of the game pieces.

In addition to amusing and entertaining the players, many board games also employ some type of teaching device, sequence, or materials in an attempt to add an educational aspect or means for increasing the knowledge or skill of the players concerning a particular subject or subjects to the game. Most of such games consist of familiar, expected and/or obvious structural configurations.

While previous games have fulfilled their respective, particular objectives and requirements, no known board game has effectively and realistically imitated the movement of players and strategy of play of a particular sport or activity while also incorporating an effective educational aspect designed to educate the participants about the rules, terminology, game situations, strategies, and history of the sport or activity being imitated in the same manner as the applicant's invention.

3. Description of Related Art

U.S. Pat. No. 1,741,596 issued to C. W. Wright discloses a baseball board game in the likeness of a baseball field, wherein a revolving disc containing characters representing events in a baseball game is situated under the game board. Only certain characters are visible at any one time through small holes or apertures in the game board, and players move the game pieces by following the instructions of the visible characters after the disc is spun and comes to rest.

U.S. Pat. No. 2,886,319 issued to R. S. Henderson discloses a combination educational and simulated baseball game having a game board in the likeness of a baseball field, a series of cards containing statistics of player batting tendencies, and a pair of dice. The tendency cards are conformed to the tendencies of professional players, thereby allowing players to learn baseball strategy. Such cards do not, however, provide a means for actively testing or questioning participants concerning the rules, terminology, game situations, strategies, or history of baseball.

U.S. Pat. No. 4,000,897 issued to D. S. York discloses a plurality of cards containing lists of words, with such cards being divided into decks based on the perceived difficulty in spelling of such words. The cards can be incorporated into a game of chance by requiring a player to spell a word correctly before completing a move in the game, thereby converting the game into a game of both skill and chance. The subject matter of the York cards, however, has no relation to the game actually being played, and in playing the York game only one card may be drawn or used by a player per turn or move.

U.S. Pat. No. 4,016,939 issued to H. M. Thron discloses a game designed to teach the "sport " hunting and hunting safety. The game utilizes several game pieces as well as two sets of cards, entitled Equipment Cards, which depict types of hunting equipment, and Situation Cards, which provide the result of a simulated shot at a target prey. Such cards are not used in the same manner as the inventor's cards, and Thron is a pathway-type board game rather than a game that imitates typical movements of the participants during real play of the sport or activity being simulated.

U.S. Pat. No. 4,121,823 issued to T. A. McBride discloses a board game designed to teach subjects such as religion. Each block in the pathway of the McBride game corresponds to a particular subject matter, which subject matter in turn corresponds to a particular set or deck of cards. When a player lands on a particular block, he or she is asked a question from the corresponding deck. Only one question may be asked per turn, however, and players cannot choose the type or difficulty of the question asked as in the inventor's game.

U.S. Pat. 4,378,941 issued to P. A. Derby discloses a board game designed to teach players to recognize particular species of birds and their habitats. The game is played by moving the game pieces along a pathway situated on the perimeter of the board, with each block representing a particular bird habitat. A player who lands on a habitat by chance must match the birds to such habitat.

U.S. Pat. No. 4,856,780 issued to S. E. Begley et al. discloses a basketball trivia game consisting primarily of a game board and cards containing a series of trivia questions arranged in order of increasing difficulty. The questions of Begley et al. are asked within the framework of a game situation simulating a real life game. However, the Begley et al. game board does not simulate a basketball court, and the difficulty of the question asked is determined by the chance means rather than at the option of the player as in the inventor's game.

U.S. Pat. No. 5,123,653 issued to G. Murphy et al. discloses a board game having a simulation of a basketball court on its face, with the court divided into zones at varying distances from the basket. Murphy et al. discloses two modes of play wherein a player must answer questions about basketball teams and players. If a question is answered correctly, either points are awarded or the player is allowed to roll the dice again. Unlike the inventor's game, however, the difficulty of the question to be asked is determined by chance, and there is no provision or option to answer an additional "challenge" question during the same players move.

U.S. Pat. No. 5,248,147 issued to D. N. S. Smith discloses a board game having different categories of question cards relating to the rules and techniques of tennis. The Smith game does not, however, have a provision for asking additional "challenge" type questions, which it is believed are used in a unique manner by the inventor.

U.S. Pat. No. 5,407,204 issued to A. G. Meyer, III discloses another baseball-type board game in which baseball trading cards are used as playing pieces. The fielding team selects pitcher cards, which indicate balls, strikes, or hits, until cards indicating a combination of 4 balls, 3 strikes, or a hit are drawn. When a hit card is drawn, the batter then draws an action card, which indicates the type of hit. The Meyer III game lacks the educational or teaching aspect the inventor's game wherein questions concerning the rules, terminology, strategy, situations and history are asked with each turn at bat.

U.S. Pat. No. 5,513,848 issued to D. N. Keener discloses a board game simulating environmental and sportsmanship issues that might be encountered while participating in a fishing tournament. The game board consists of an illustration of a body of water with pathway-type blocks spaced along the bank or perimeter that identify an action to be taken based on a roll of a dice. The object of the game is to acquire "Bait" cards representing different fishing baits that are used to catch "Bite" cards corresponding to a species of fish. The player with the most poundage of fish represented on the "Bite" cards at the end of the game is declared the winner.

U.S. Pat. No. 5,516,290 issued to R. L. Quigley et al. discloses a board game designed to educate players about proper skateboarding methods and safety. The object of the Quigley et al. game is to traverse a path while collecting all of the necessary safety equipment involved in skateboarding. The Quigley et al. is an example of a game designed to educate players about a particular sport, albeit in a different manner than in the inventor's game.

U.S. Pat. No. 5,884,914 issued to M. Lilien discloses a baseball related board game designed to more realistically portray a professional baseball game. Each player rolls a pair of dice simultaneously. When the offensive player rolls a higher number than the defensive player, "action" cards are used to determine the course of play. If the offensive player wishes to advance an extra base, the dice are again rolled and the extra base is granted if the offensive player again rolls a higher number than the defensive player. Lilien does not, however, include any means for teaching the rules, terminology, strategy, situations, or history of the game of baseball.

U.S. Pat. No. 5,901,956 issued to T. L. Warmack discloses a board game which uses question cards preferably relating to the sport or game being simulated. Generally, the offensive player is asked a question by the defensive player. If the offensive player answers correctly, such player then spins a typical spinner to determine the next outcome or move. Movements apparently also follow the traditional rules of the game being simulated. The Warmack game does not, however, allow players to ask or answer more than one question per as in the inventor's board game.

The board game "Rules of the Game" manufactured by Game Technologies, Inc. calls for players to move game pieces around a game board based on their answers to questions pertaining to hypothetical situations that might occur while playing baseball, football, basketball, or golf. Such game, however, is a pathway-type game, and the type of question asked is determined by the space which the player occupies.

Although almost every board game has its particular novel and attractive features, as evidenced by the above patents, the inventor does not believe that any known board games include the inventor's unique combination of elements. In particular, the inventor's use of "challenge" cards provides an unexpectedly pleasing result in that it creates a significantly more realistic and fast-paced game experience by adding an additional strategic element to the game and allowing the simulation of occurrences such as base-stealing, errors in fielding, and other elements not shown in previous sports or educational-type games. In addition, the inventor's game includes a means for teaching the unique rules, terminology, strategy, situations, and history of different levels or variations of a particular sport or activity, such as Little League baseball, softball, Major League baseball, and collegiate and minor league baseball.

OBJECTS OF THE INVENTION

It is therefore an object of the present invention to provide a new and improved board game that is entertaining and amusing to the players.

It is a further object of the invention to provide a board game that also includes a teaching or educational aspect.

It is a still further object of the invention to provide a board game in which the teaching or educational aspect is designed to teach the participants about the rules, terminology, strategy, situations, and history of the game or activity being simulated.

It is a still further object of the invention to provide a board game in which the game board realistically depicts or portrays the standard arena or environment in which the game or activity being simulated typically occurs.

It is a still further object of the invention to provide a board game in which the game pieces are moved in a manner simulative of typical movements of players or participants of the game or activity being simulated.

Still other objects and advantages of the invention will become clear upon review of the following detailed description in conjunction with the appended drawings.

SUMMARY OF THE INVENTION

The present invention provides a unique board game and method of playing that is both a game of chance and an educational game designed to be played by two or more players wherein as players or participants answer questions about the rules, terminology, strategies, situations, and history of a particular sport or activity, such sport or activity is realistically portrayed or simulated on the game board. A typical game includes a game board, die, a coin, scoring tablets, game pieces preferably in a shape depicting typical players, and playing cards. The playing cards are preferably divided into at least two sets or decks with one set consisting of regular questions and the second set consisting of "challenge" questions. Each card contains at least one question and the corresponding correct answer preferably related to the sport or activity being simulated.

The face of the game board contains a representation of a playing field or other environment typical of the sport or activity being simulated. In a preferred embodiment, the game board depicts a typical baseball field, including an infield, outfield, bases, pitchers mound, an upright outfield wall having advertising billboards on its face, and a scoreboard. However, other sports or activities may be just as easily simulated.

The playing cards are preferably divided based on the degree of difficulty of the questions, with the "challenge" questions generally considered more difficult than the regular questions. Both the regular question and "challenge" question cards preferably contain questions about the rules, terminology, strategy, situations, or history of the sport or activity being simulated. In the preferred embodiment, the cards may contain questions pertaining to Little League baseball, softball, minor league or collegiate baseball, and professional baseball rules, terminology, strategies, situations, history, and the like.

In the preferred embodiment, play begins with a coin flip to determine the home and visiting teams, with the visiting team batting first. The die is preferably six-sided and contains indicia representing either a "single," "double," "triple," or "home run" on four of the faces and indicia representing an "out" on the other two faces. The outcome of a roll of the die indicates the preliminary outcome of an at-bat. If the die lands with one of the "hit" designations facing up, the batting player must correctly answer a question from the regular question cards asked by a fielding or defensive team player before the designated "hit" can be executed. In a sense, the roll of the dice indicates the success or lack of success of the batter in hitting the ball, and the question cards can be thought of as being simulative of the success of the fielder in fielding the ball.

If the batting player answers the regular question incorrectly, an out is recorded. If the batting player answers a regular question correctly, a player piece is moved to the designated base. Then, at the option of the batting player, he or she may ask a fielding team player a question from the set of "challenge" questions if he or she wishes to try to advance the runner(s) an extra base, i.e. stretching a single into a double, a double into a triple, or a triple into a home run. If the "challenge" question is answered correctly by the defensive team, the batting player piece or pieces remain on the base indicated by the die. However, if the defensive team fails to answer the challenge question correctly, the batting player will extend the designated hit by one extra base. Thus, a correct answer to a challenge question by the fielding team can be thought of as representing good defense or a good fielding play, while an incorrect answer to a challenge question by the fielding team can be thought of as simulating a fielding error, stolen base, or the like. The number of challenge questions that may be asked per at bat is preferably limited to two. In alternate playing strategies, the batting team may be asked both the regular and challenge questions by the fielding team, or the batting team may choose the type of question he or she wishes to answer, with the number of challenge questions that can be asked per team per at bat again limited to two. In yet another alternative playing strategy, if the batting team player rolls an "out", he or she will then ask a fielding team player a question from the cards. If the question is answered correctly, the out is recorded, thereby representing errorless fielding the ball. However, if the question is answered incorrectly, the player is allowed to move to the designated base, thereby representing a fielding error. A typical game is played for seven innings.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 8:
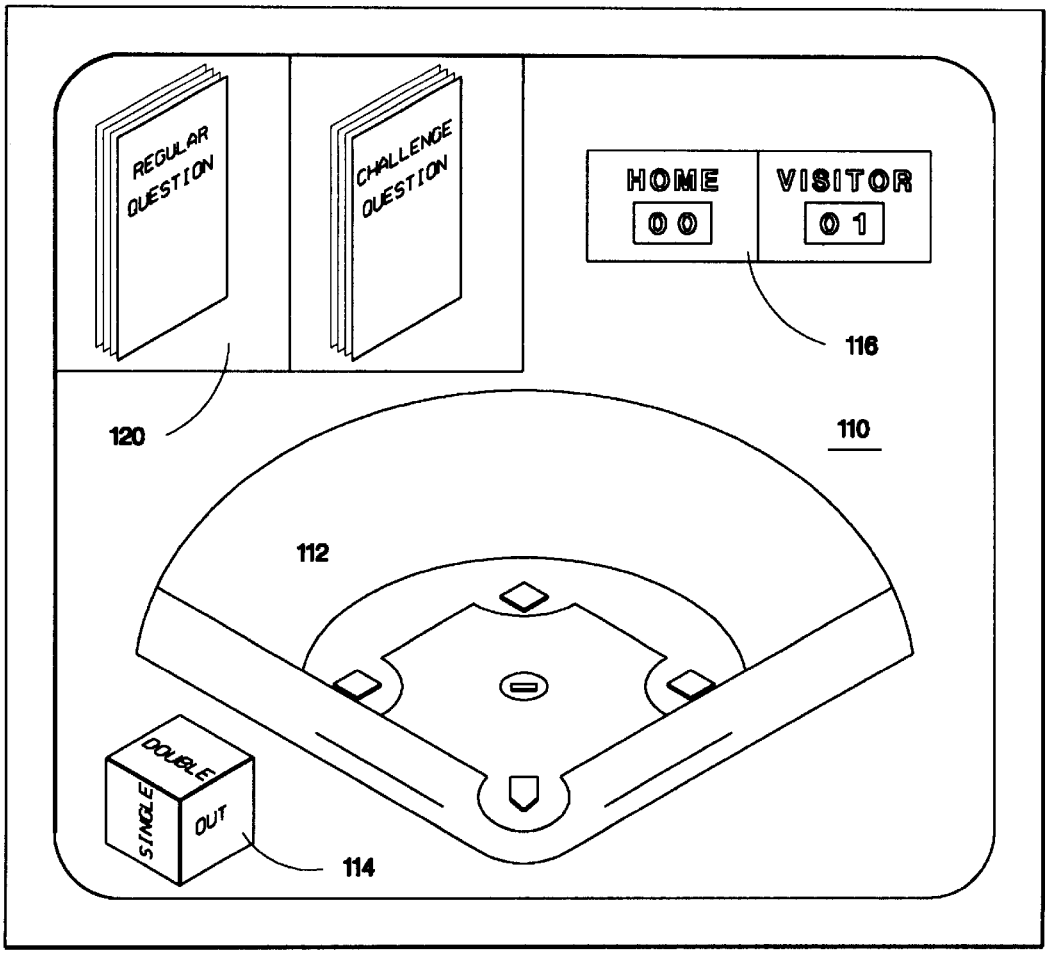
FIG. 8 is a front view of an electronic version of the preferred embodiment of the invention.
Figure 9:
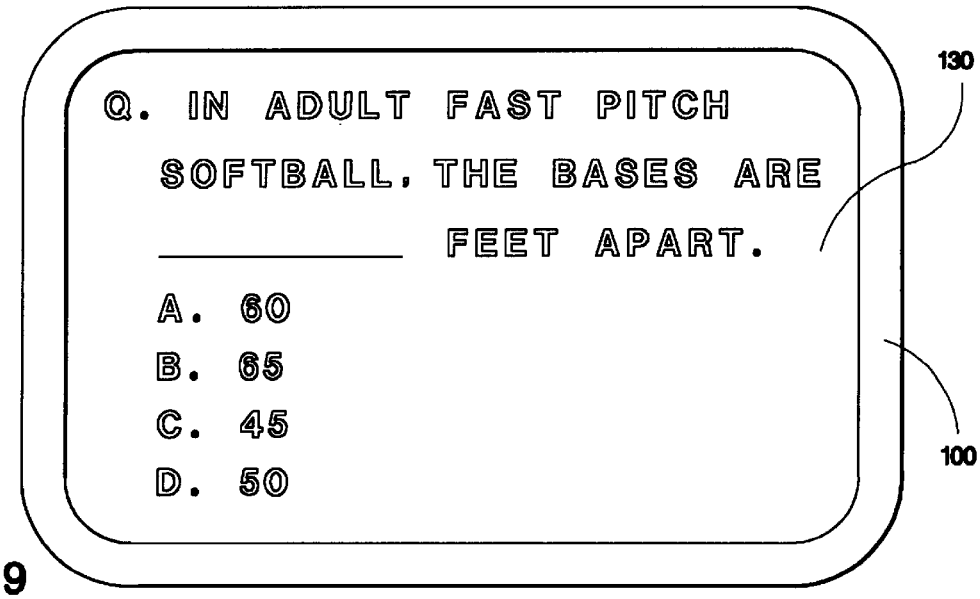
FIG. 9 is a further view of one of the question cards in an electronic version of the preferred embodiment of the invention.

Referring now to the Figures, FIGS. 1–7 show the various components of the preferred embodiment of the board game apparatus of the invention and additional features of games played employing the apparatus. As will hereinafter be more fully described, the board game apparatus of the preferred embodiment includes a means for realistically portraying a game field or playing surface such as a baseball or softball field and stadium, as well as means for simulating the basic movement of players in such game. In addition, the board game apparatus includes a teaching or educational aspect, wherein the players are asked questions about the rules, terminology, strategies, situations, and history of the sport, including trivia type questions about the cast of colorful players, managers, announcers and the like who have been involved or are involved in such sport. The inventor's basic apparatus can be easily adapted to portray and teach players and other interested parties about the rules, terminology, strategy, situations, and history of virtually any sport or activity. It is also envisioned that a video or computer game version of the game, such as shown in FIGS. 8 and 9, would be equally as entertaining and educational.

Figure 1:
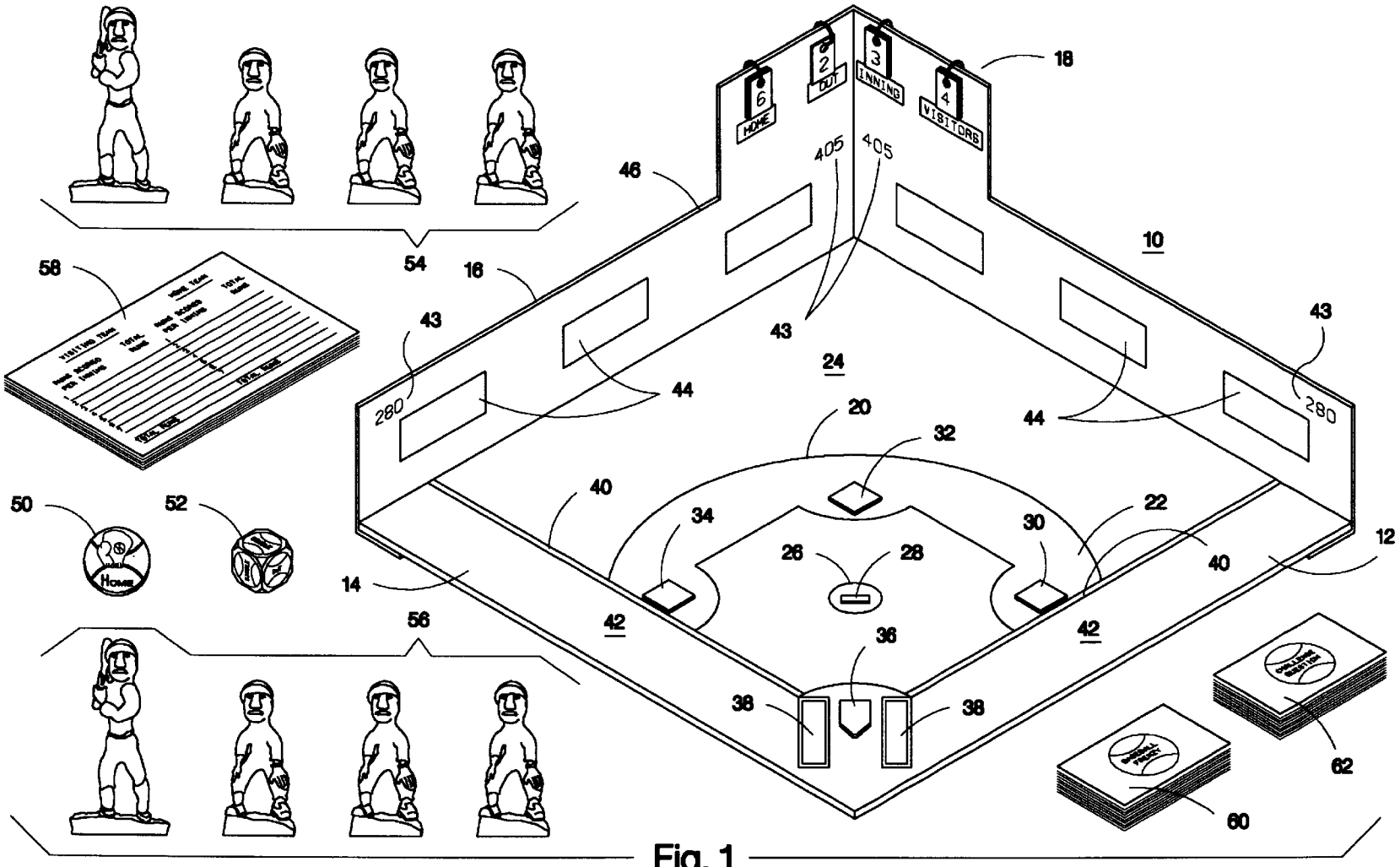
FIG. 1 is a perspective illustration of the preferred embodiment of the game board of the invention.

FIG. 1 shows the various elements of the board game 10 of the preferred embodiment of the invention. The game 10 includes a game board 12, a coin or token 50, die 52, home team and visiting team game pieces 54 and 56, scoring sheets 58, regular question cards 60, and "challenge" question cards 62. Game board 12 is simulative of a baseball field, having a playing surface 14, an outfield wall 16, and a scoreboard 18. The playing surface 14 is preferably generally square in shape, approximately 18 inches by 18 inches, and fashioned from a stiff material such as cardboard or thin plastic. Preferably, the game board 12 is also foldable so that it can lie flat for easy storage. The face of the playing surface 14 contains a representation of a baseball field 20 having an infield 22 and outfield 24. The infield 22 is in the shape of a conventional baseball diamond having a central, generally circular pitcher's mound 26 and pitching rubber 28, three square bases representing first base 30, second base 32, and third base 34, and a pentagonally shaped home plate 36. Two generally rectangular batters boxes 38 are positioned on opposite sides of home plate in a generally parallel orientation. Lines 40 define the boundaries of the baseball field 20 and foul territory or in-play area 42. The baseball field 20 is preferably formed from a soft felt material which is attached to the playing surface 14, although it could also be represented in other forms such as a picture or drawing adhered to or painted directly onto the playing surface 14. Different colors can be used to represent areas such as the grass and dirt portions of the field 20, as well as home plate 36 and the bases 30–34, or to indicate the colors of a particular favorite team or league.

The outfield wall or fence 16 extends vertically along the periphery of the outfield portion 24 of the field 20 and the in-play area 42. The wall 16 is preferably formed from a rigid cardboard or plastic material similar to the playing surface 14. Numerals 43 are spaced along the inner surface of the outfield wall 16 to indicate the distance from home plate 36 to such point on the wall 16. Additionally, advertising billboards shown in FIG. 1 as rectangles 44 may be spaced along the inner surface of the wall 16. Scoreboard 18 extends from the upper edge 46 of the wall 16 in center field, although the scoreboard could be situated in any suitable position along the wall 16. It is preferable that the scoreboard 18 at least have means for representing the number of runs scored by the home and visiting teams, as well as the number of outs and the inning number. As indicated above, the outfield wall 16 and scoreboard 18 preferably may be collapsed to lie flat against the playing surface 14 for storage of the game board and pieces when not in use.

Figure 2A:
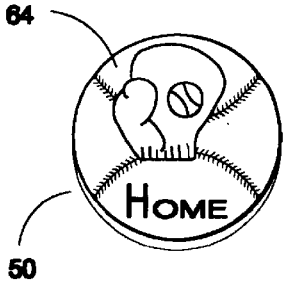
FIG. 2*a* is a view of the front side of the coin or token of the invention.
Figure 2B:
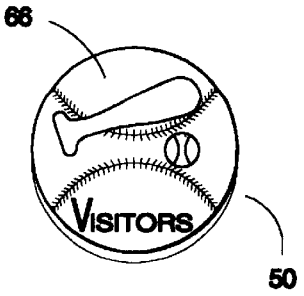
FIG. 2*b* is a view of the back side of the coin or token of the invention.
Figure 3:
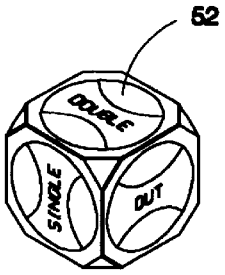
FIG. 3 is a perspective view of the chance determining means of the invention.
Figure 4A:
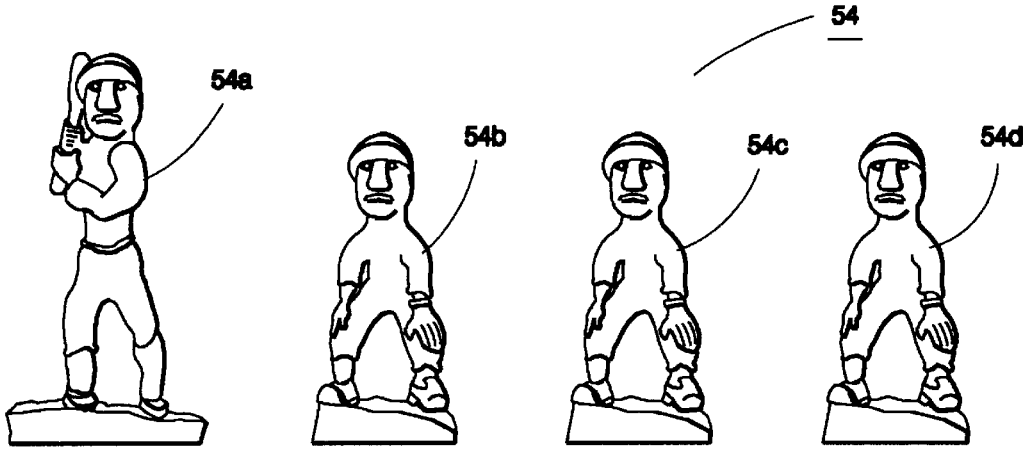
FIGS. 4*a* and 4*b* each show a front view of the game pieces of the invention.
Figure 4B:
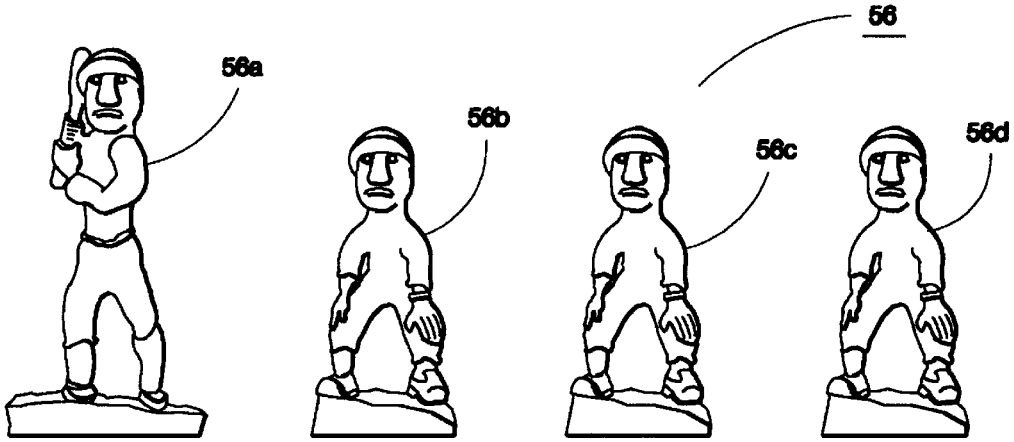

FIGS. 2 through 7 how the additional elements of the preferred embodiment of the invention. FIG. 2 shows a coin or token 50, which can be flipped at the beginning of the game to determine the home and visiting teams. As shown in FIG. 2*a*, one face 64 of the token, having a representation of a baseball mitt and the word "home," represents the home team, while the opposite face 66, shown in FIG. 2*b* having a representation of a baseball bat and ball and the word "visitors," represents the visiting team. FIG. 3 shows the chance-determining means of the invention in the form of a standard die 52 having six (6) sides, although other alternative suitable chance-determining means such as a conventional spinner could also be used. Each side or face of the die has imprinted thereon some indicia indicating either a "hit", with the words "single," "double," "triple," or "home run" imprinted on one of four (4) faces, or an "out" designation, with the word "out" imprinted on the other two (2) faces. FIGS. 4*a* and 4*b* show the home and visiting team playing pieces designated generally as 54 and 56, respectively, used while such team is batting. Both the home team and visiting team have one batter piece, designated in FIGS. 4*a* and 4*b* as 54*a* and 56*a*, respectively, and three runner pieces numbered 54*b*, 54*c*, 54*d*, and 56*b*, 56*c*, and 56*d*, respectively. When a player is batting, piece 54*a* or 56*a* is placed in the batters box 38 on the field 20. If a player or players reaches base safely, player pieces 54*b–d* or 56*b–d* are placed on or near the appropriate base 30–34. Home and visitor team pieces are preferably of different colors, for example with the home team pieces being generally red and the visitor team pieces being generally blue. Fielding player pieces may also be included if desired, although such pieces are not considered necessary to the enjoyment and success of the game.

Figure 5:
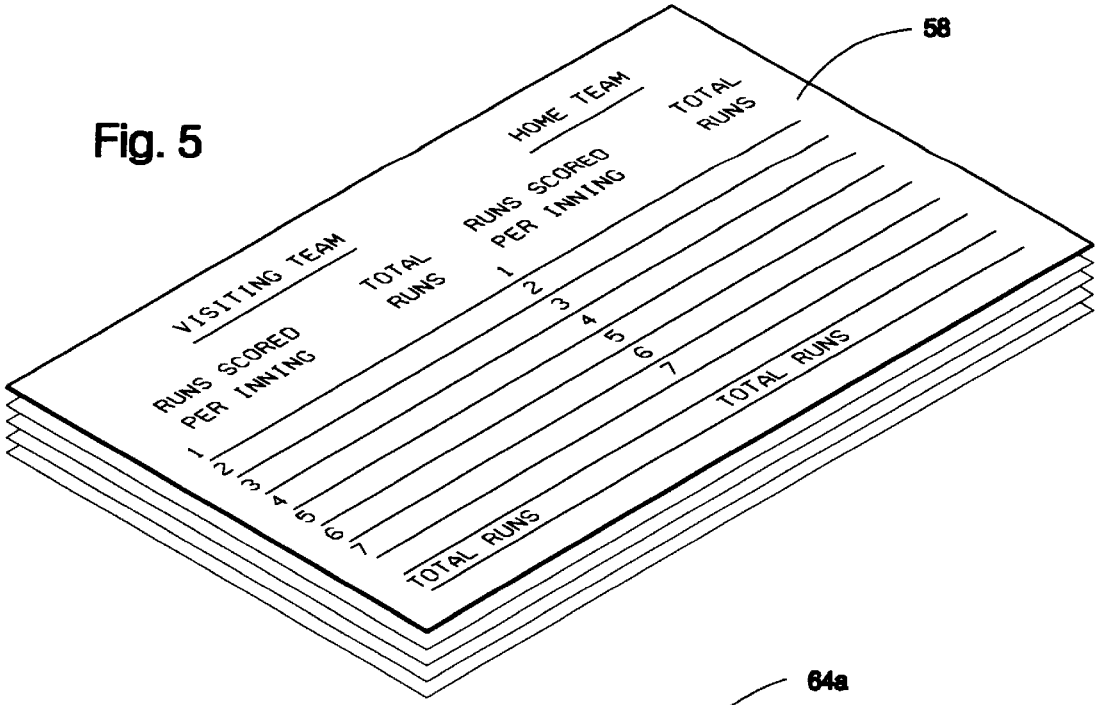
FIG. 5 is a perspective view of the scoring sheets used with the invention.

FIG. 5 shows a scoring sheet 58 used during game play to record the number of runs scored by each team per inning as well total number of runs. Such scoring sheets could of course be adapted to keep track of other game events, such as the total number of hits, types of hits, as well as the number of regular or "challenge" questions answered correctly or incorrectly as the case may be.

Figure 6A:
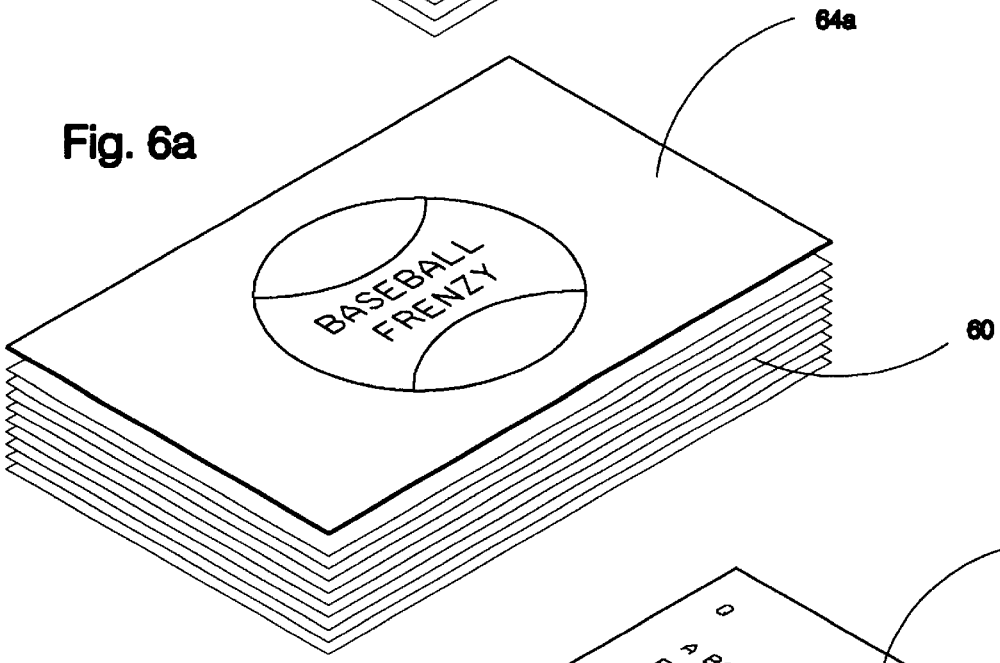
FIGS. 6*a* and 6*b* show the regular question cards of the invention in a face up and face down orientation, respectively.
Figure 6B:
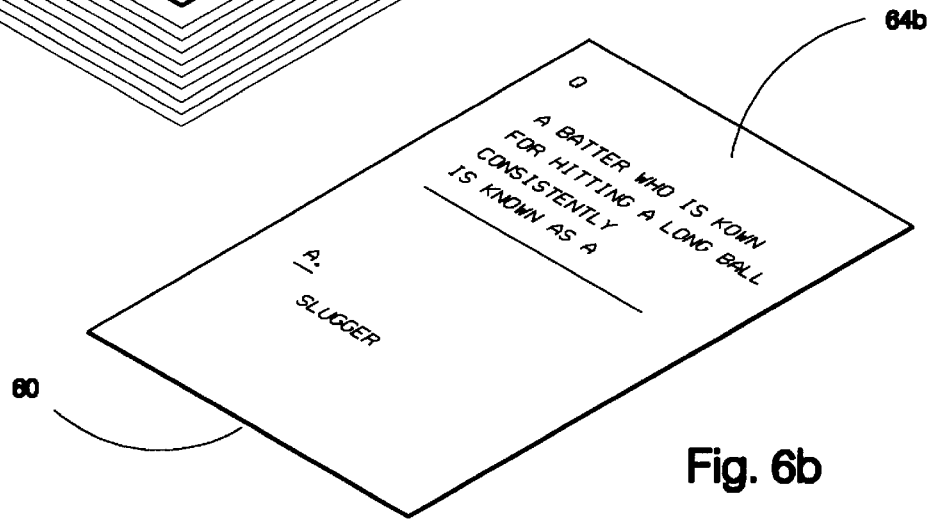
Figure 7A:
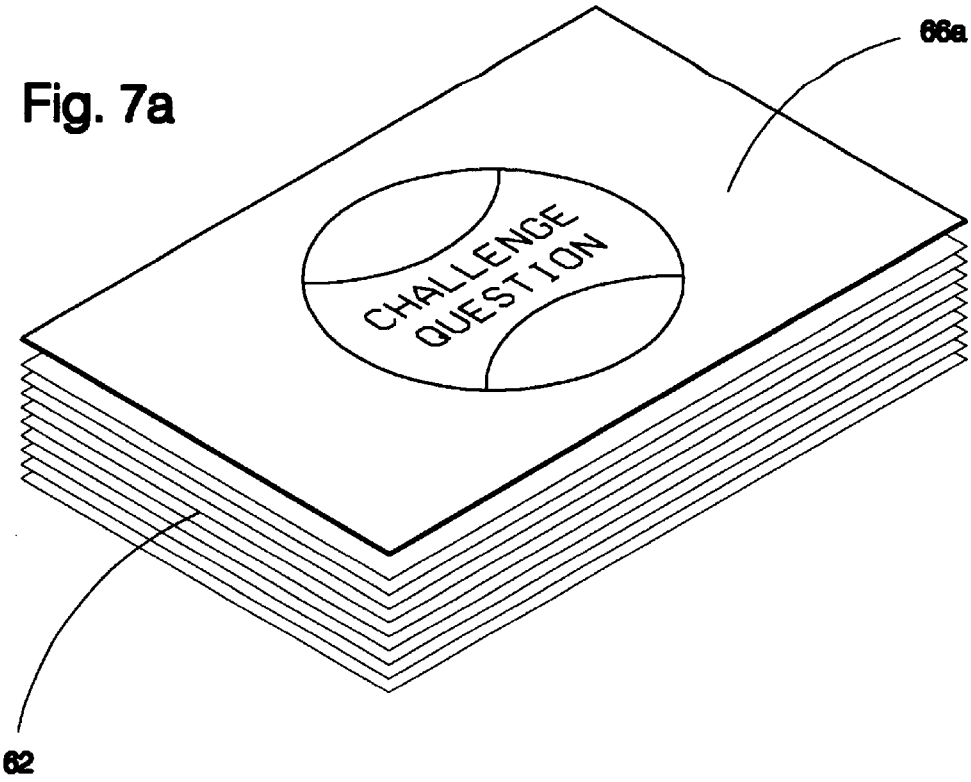
FIGS. 7*a* and 7*b* show the challenge question cards of the invention in a face up and face down orientation, respectively.
Figure 7B:
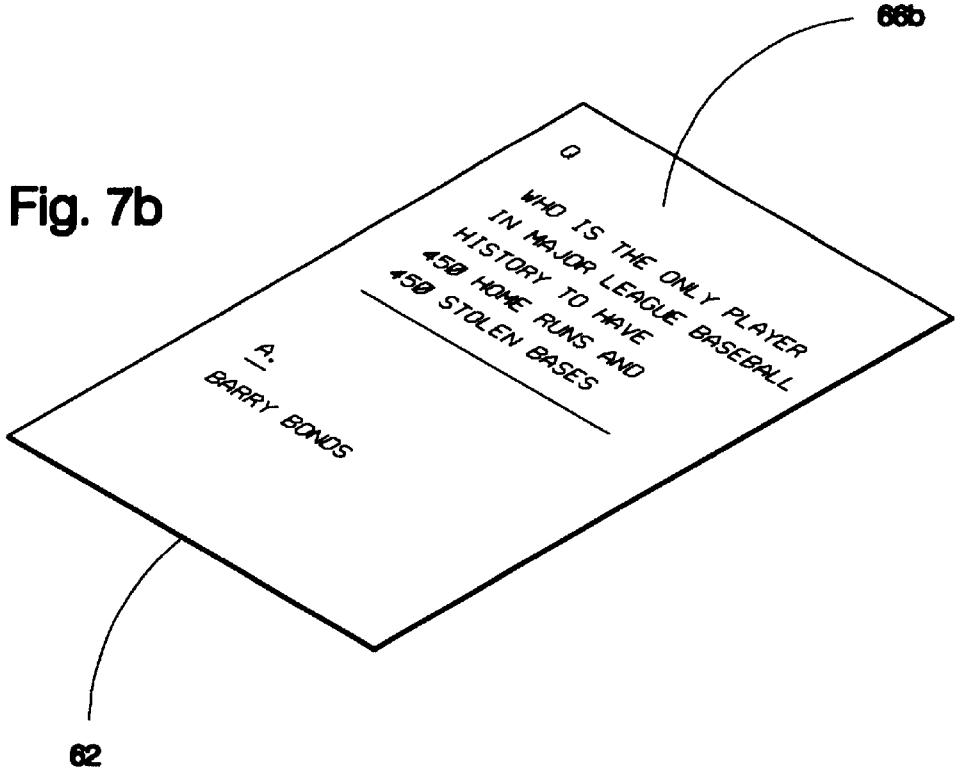

FIGS. 6–7 show the regular question cards 60 and "challenge" question cards 62 of the invention. Each card has a back face 64*a* and 66*a*, shown in FIGS. 6*a* and 7*a*, and a front face 64*b* and 66*b*, shown in FIGS. 6*b* and 7*b*. As shown in FIGS. 6*a* and 7*a*, the back face of each card preferably includes indicia indicating the type of card. FIG. 6*a* shows the back 6*a* of a regular question card 60 having the words "Baseball Frenzy" imprinted thereon, while FIG. 7*a* shows the back 66*a* of a "challenge" question card 62 with words "Challenge Question" imprinted thereon. Of course, any wording or design that distinguishes the types of cards may be used. In addition, the cards can be divided into more than two separate decks if desired. FIG. 6*b* shows the front 64*b* of a regular question card 60 having a question pertaining to the sport of baseball on the upper portion of the face and having the answer to such question situated on the lower portion of the face below the question.

FIG. 7*b* shows the front face 66*b* of a "challenge" question card. The regular and challenge questions may be of any desired question type or format, such as multiple choice, fill in the blank, true/false, or the like. However, the cards are preferably divided such that the regular question cards 60 contain questions that are generally perceived as being less difficult to answer, while the challenge question cards 62 contain questions that are generally perceived as being more difficult to answer. Calculating the difficulty of individual questions can be determined in several ways, such as by a statistical analysis of the number of times such questions are answered correctly or incorrectly by a representative sample of any given cross-section of the public such as, for example, baseball fans or the like. Of course, individual questions may be easily made more or less difficult, such as by providing more or less information, by altering the wording, etc. If desired, the cards can be even further divided beyond the basic regular question and challenge question types, such as into groups of regular question cards pertaining to Little League baseball, or challenge questions pertaining to the history of the game. However, it is preferable that at least some of the questions are in the form of hypothetical game situations requiring the player to act as an umpire and "make the call." Other typical topics may include questions concerning the history of the sport, facts and statistics of famous players, announcers, and famous owners, announcers, umpires, and the like.

In determining the regular and challenge questions or cards, the difficulty of the various questions can be evaluated subjectively by the designers of the game or by knowledgeable authorities in the sport involved, or may be selected more objectively by any suitable statistical procedure. For example, questions may be presented to selected persons or groups selected randomly from the general public at large or select groups of persons who may be knowledgeable or not concerning the game in question and then placing the questions into two or more categories based upon how many persons from such group correctly answer each question.

To start play, the game board is unfolded and generally set up as shown in FIG. 1. The regular and challenge question sets or decks preferably are placed on the outfield area of the game board, while the home and visiting team figurines are placed on opposing baselines. Players are divided into two teams. The youngest or oldest person playing the game may, for example, flip coin 50 to determine the home and visiting team. If the coin lands with the "home" side facing up, that team is the home team and takes the red figurines 54, and the other team is the visiting team and takes the blue figurines 56. If the coin lands with the "visitors" side facing up, that team becomes the visiting team and takes the blue figurines 56, and the other team takes the red figurines 54. Following widely accepted baseball and softball rules, the visiting team bats first.

Play begins with a visiting or batting team player placing the red batter figurine 56*a* on the game board in the batter's box 38 and rolling the die 50. The die will show either an "out," "single," "double," "triple," or "home run." In the preferred embodiment. If a "single," "double," "triple," or "home run" is rolled, a member of the opposing or fielding team will then ask the batting team a question from one of the regular question cards. Questions can be directed to individual team members or the team as a whole as desired. If the batting team as a whole is allowed to answer a question, one answer must be agreed upon. If the batting team responds with an incorrect answer to the regular question, this will count as one out and the batting team will roll the die again. If the batting team rolls an "out," no regular question is asked by the fielding team and an out is recorded. Each team gets three outs per inning. If when a "single," "double," "triple" or "home run" is rolled, and the batting team correctly answers the regular question asked by the fielding or defensive team, one of the player pieces 56*b–d* is then moved to the appropriate base, i.e. a single would put a runner on first base, a double would put a player on second base, a triple would put a runner on third base, and a home run will move a player around the bases and score a run.

Players on base at the time a hit is recorded will advance as follows, assuming that the questions are answered correctly. Generally, a runner on base will advance a number of bases equal to the number indicated by the type of hit recorded. For example, if there is a runner on first and a single is rolled, such runner will move from first base to second base, stopping at second base. If there is a runner on second base and a single is rolled, the runner on second base will move from second base to third base and stop at third base. If there is a runner on third base and a single is rolled, the runner on third base will advance one base and score a run. If there is a runner on first base and a double is rolled, the runner on first base will advance two bases and stop on third base. If there are runners on second and/or third base and a double is rolled, the runners on second and/or third base will score. If the die is rolled and indicates an "out, then a question from the regular question cards is not asked and an out is recorded, and the players on base will remain in the same position. Teams gets three outs per inning as in a typical baseball game.

It can be seen that the results of rolling the dice can be thought of as illustrative of the success or lack of success of the batter in hitting the ball. In addition, correctly answering a question from the regular question cards can be thought of as simulating the success of either the batter running to the designated base or of the fielder in fielding the ball. For example, if a batting player rolls a double but then cannot correctly answer the regular question, this can be envisioned as simulating a situation wherein normally the batter's hit would have resulted in a double, but as a result of a "great fielding play" made by the fielding team, an out is recorded instead.

Variations or modifications can be easily made to the die, such as by adding "ball" and "strike" designations, or by increasing the number of die from one to two, and such modifications can be easily incorporated into regular game play. In addition, the use of an alternative chance determining means, such as a spinner having "hit" and "out" designations similar to the die, could also provide an equally realistic and unique game experience.

The "challenge questions" can be used in several different ways during play. Before starting play, the players will set ground rules of play concerning exactly how the challenge questions will be used. In the preferred embodiment, the challenge questions may be used by the batting team to try to increase a hit by one base, i.e. effectively turning a single into a double, a double into a triple, or a triple into a home run. Preferably, the number of challenge questions that can be asked is limited to two per inning for each team. It is believed that by limiting the number of challenges allowed per inning, players are forced to use the challenge questions at strategic times during game play, rather than merely asking a challenge question after each hit. The challenge questions also provide a unique means and incentive for teaching players more difficult or lesser-known information related to the game.

After a batting player safely reaches base by first rolling a "hit" and correctly answering a regular question, such batting player can then ask a challenge question to a member of the fielding or defensive team. If the fielding team player answers the challenge question correctly, the "hit" rolled by the batting team player will not be extended an extra base but will remain as initially rolled. However, if the fielding team incorrectly answers the challenge question, the "hit" will be extended an extra base. Correctly answering the challenge question by the fielding team can be thought of as simulating a good defensive play in not allowing the batter to stretch a single into a double or the like. On the other hand, an incorrect answer to a challenge question can be thought of as simulating a smart baserunning play wherein the batting player, through his or her speed or baserunning skill, successfully stretches a single into a double or the like. In testing the game, the inventor has found that having the batting team ask the fielding team challenge questions is one of the more preferred methods for using the challenge questions, since it gets the defensive more involved in the game and encourages the use of the challenge questions, as there is no penalty if the defensive team correctly answers the question. Using this method, the inventor has found that more challenge questions are asked per inning, thereby allowing a greater number of more difficult questions to be asked during an entire game.

In an alternative embodiment, rather than having the batting team ask the defensive team challenge questions, the batting team can request to be asked a challenge question by the defensive team. If the batting team correctly answers the challenge question, the runner is advanced an extra base. However, if an incorrect answer is given to the challenge question, the original "hit" is taken away and an out is recorded. In this embodiment, the correct answering of a challenge question by the batting team can be thought of as representing good baserunning by a runner or a throwing error by the fielding team. In addition, since in a live game the number of attempted stolen bases or throwing errors is usually minimal, limiting the number of challenge questions to two per inning per team appropriately patterns this tendency.

In another alternative embodiment of the game, instead of a player on the batting team rolling the die, a player from the defensive or fielding team will roll the die. If a "hit" is rolled, the team up to bat will then have to answer a question asked by the defensive team. In this embodiment, challenge questions may be used or requested by a team or player in place of regular questions twice per inning per team. By answering a challenge question correctly, a single will be turned into a double, a double will be turned into a triple, and a triple will be turned into a home run. The same rules concerning runners on base will apply. This option allows the players to choose to try to answer a more difficult question rather than a regular question twice per inning, thereby adding another strategic element to the game of determining if and when to use such challenge questions. For example, if the batting team is behind and needs extra runs, such team will be more likely to take a chance on being able to correctly answer a challenge question in exchange for the possibility of advancing an extra base and therefore hopefully scoring more runs. Other embodiments are also envisioned wherein the regular and/or challenge questions may be asked of particular players or teams.

A typical game will last for seven (7) innings. The team with the highest number of runs at the end of the game is declared the winner. In addition, if at the bottom of any inning one team has a total of twenty (20) runs, such team may be declared the winner and the game over. Each team uses a scoring tablet as shown in FIG. 5 to keep track of the runs scored each inning. In addition, the scoreboard 18 will be updated as runs and outs occur throughout the game to reflect the correct score, as well as the inning and the number of outs at any given time. In one embodiment, red inning numbers on the scoreboard represent the top of an inning, and black inning numbers represent the bottom of each inning. When the red inning numbers are showing, the visiting team will be answering questions, and when the black numbers are showing, the home team will be answering questions. In the case of a tie, extra innings may be played. In this case, a visiting team player may flip the coin to determine who will be at bat or answer questions first in extra innings. In one embodiment, the player or team that scores first will win. In another embodiment, the game will progress, as with a normal baseball game, wherein full innings will be played until at the end of any given inning the game is not tied.

As can be seen from the description above, there are two broad procedures for use of the question cards where there are at least two players. In the one procedure, or method of playing the game, the team at bat or otherwise advancing or moving the ball usually involved in such games or activities, will use the chance or probability determining device, usually a die or spinner, to determine whether or how far the ball may be advanced. That team player may then push or be dealt a regular game card, and if he or she correctly answers the question propounded will then be awarded extra bases, extra yardage, or the like in addition to that indicated by the chance determining device. Alternatively, the team advancing the ball may have to correctly answer the question in order to retain the advance awarded by the chance determining device or, as a further alternative, the full advance awarded or indicated by such device. For example, in a simulated baseball game, if the chance device indicates a "two bagger," or two base hit, and the team member of the batting team then draws and correctly answers a question, such two base hit may be extended to extra bases, wherein if the question is not correctly answered then the indication of the chance determining device will be conclusive. However, if the game is being played in accordance with the rule that correctly answering a question allows one to retain what is awarded by the chance indicating device, then failure to answer correctly will result in loss of some or all of what the chance determining device awards.

In the other broad method or procedure for playing of the game or use of the cards or questions, the chance determining device will be operated by or for the player attempting to advance the ball, and the questions will be answered by a number or numbers of the opposing team. In this procedure, which is in some respects more realistic if the question is correctly answered, the gain indicated by the chance determining device may be completely nullified just as if, for example, in baseball, what would have been a "two bagger," or two base hit, may be completely nullified by a fielder catching the ball, or may be partially nullified by expert fielding of the ball.

In both of these major categories or ways of playing the game, the party answering the challenge questions also, which may be absolute or alternatively limited to only certain numbers of times in each unit of play. For example, in the game of baseball, if the throw of the die indicates a home run, the fielders by correctly answering a regular question may be able to reduce this to a "three bagger" or a three base hit and then by again answering a challenge question, if a challenge question is available, may be able to further reduce this to only a one or two bagger. Electing to try to answer a challenge question and failing can also be arranged to increase the advance of the ball over that gained from the chance-determining device. This introduces additional strategy considerations in the game, since one may not wish to use up ones limited challenge questions or run the risk of not answering a difficult question and end up actually advancing the ball.

Over time, the educational or teaching value of the game becomes more and more evident. As outlined in the preferred embodiment above, each time a "hit" is rolled by either team, a player must correctly answer at a minimum one regular question before the "hit" indicated on the die is executed and the runners advance around the bases. The regular questions are considered easy enough so that the average player will not become overly frustrated because he or she cannot answer any questions, but difficult enough so that there is still some challenge to the players in answering such questions. The "challenge questions," however, although on the whole are statistically more difficult to answer than the regular questions, reward players who choose to try to answer such questions with an extra base, and therefore increase the chance of scoring runs. Over time, the more the game is played, the more the players will become familiar with the rules, terminology, strategy, situations and history of the game or activity portrayed on the game board. In addition, the board game is not only beneficial to those who actually play the game, who will presumably become better players as the result of increased knowledge and understanding of the rules, terminology, situations, and strategy. For example, coaches can increase their skill levels by practicing or contemplating hypothetical game situations simulated with the board game, thereby enabling them to make more informed coaching decisions. In particular, volunteer umpires at the Little League level, who of course are not as experienced or familiar with the rules as, for example, major league umpires, can become more familiar with rules through playing the inventor's board game. In addition, persons who wish to serve as scorekeepers will learn how to do so. Even those who do not participate in the sport or activity being simulated but enjoy such sport or activity as a spectator will presumably enjoy watching such sport even more with a greater understanding or knowledge of the rules, terminology, situations, strategy and history of the game. Also, because the questions are asked out loud, all players will have the benefit of hearing every question and listening to or thinking about the correct answer. Thus, the game is not only an educational and entertaining recreational vehicle for those who partake or take part in the sport or activity being simulated in real life, but can be entertaining and beneficial to anyone who enjoys such board games. The inventor's game is unique not only in that it combines a means for increasing one's knowledge of a particular sport while simulating the play of such sport, but in addition the use of "challenge" cards in the manner contemplated by the inventor provides a unique vehicle for rewarding players who wish to risk answering more difficult or challenging questions.

Although the question cards of the preferred embodiment of the invention are designed to teach players about the rules, terminology, situations, strategy, and history of the game of baseball in general, the inventor contemplates alternative embodiments in which the question cards may be directed towards teaching the particular rules of Little League Baseball, college baseball, softball, or Major League baseball depending upon the interests of the players. Tables 1 and 2 below give examples of typical regular and challenge questions divided into subgroups based on the type of question and the subject matter of such question.

TABLE 1

Regular Questions

| | RULES | STRATEGIES | STATS | HISTORY | SITUATIONS | TERMINOLOGY |
|---|---|---|---|---|---|---|
| Little League | T of F<br>There are weight standards for little league baseballs.<br>True. They should weigh no less than 5 and no more than 5¼ ounces. | In Little League, if a player pitched in four or more innings on Sunday, that player can pitch again on _____.<br>Thursday | Youth baseball leagues are organized by ____.<br>A. schools<br>B. churches<br>C. park districts<br>D. all of the above | Little League Baseball was initiated for youngsters between the ages of ____.<br>A. 10–12<br>B. 8–12<br>C. 9–10<br>D. 9–12 | In Little League, when the pitcher receives the ball, he or she has ____ seconds to pitch the ball again if no one else is on base.<br>A. 12<br>B. 15<br>C. 30<br>D. 20 | In little league, the umpires must wear a ____, shin guards, and a mask.<br>Chest protector |
| Softball | T or F<br>In girls fast-pitch softball, a pitcher may stop or reverse their forward motion before delivering the pitch.<br>False. No stopping or reversing motion may be made. | T of F<br>A.S.A. softball rules allow for substitutes to be removed from a game and re-entered later.<br>False. | There are less than ____ inductees in the National Softball Hall of Fame.<br>A. 220<br>B. 200<br>C. 250<br>D. 325 | T or F<br>In ____, eight years after the indoor softball game was developed, the game was adapted for outdoor play.<br>A. 1899<br>B. 1895<br>C. 1912<br>D. 1889 | An ____ will be called if a fake tag occurs when a fielder without the ball deceives the runner by affecting his or her progress in softball.<br>obstruction | In softball any illegal bat used by a hitter will result in a(n) ____ if it is noticed before a pitch is thrown to the next batter.<br>out |
| Major League | In the major leagues, all types of interference result in ____.<br>A. someone thrown out of the game<br>B. an injury<br>C. a dead ball situation<br>D. the mound being charged | In the major leagues, the most common appeal is ____.<br>A. On a tag play.<br>B. On a half-swing.<br>C. Missing a base.<br>D. Leaving a base too early after a caught ball. | The all-time home run leader in Major League Baseball is:<br>A. Pete Rose<br>B. Babe Ruth<br>C. Mark McGuire<br>D. Hank Aaron | The "House that Ruth built" was ____ built to accommodate the crowds that showed up to see baseball's Babe Ruth.<br>A. Wrigley Field<br>B. Veterans Stadium<br>C. Yankee Stadium<br>D. Fenway Park | A common strategy late in a game when the opponent has runner on second base and ____ base is open, the manager may order an intentional walk to make it easy to get a force out.<br>first | A minor league club that is associated with a major league club, for the purpose of developing young players is known as a(n) ____.<br>Farm team |
| General | When a protested game is upheld, the game is rescheduled from ____.<br>The point at which it was protested. | When covering a bunt, usually the _____ and _____ charge toward the plate when the pitcher releases the ball.<br>First baseman and third baseman. | An award given to a player who leads the league in home runs, runs batted in and batting average is the _____.<br>Triple crown | Junior League Baseball was developed as a minor league division of Senior League Baseball for ____ year olds only.<br>13 | A baserunner who misses a bag will be called out if the umpire visually witnessed the act.<br>False. An appeal must be made also. | The abbreviation used for the first baseman position is ____.<br>1B |

TABLE 2

"Challenge" Questions

| RULES | STRATEGIES | STATS | HISTORY | SITUATIONS | TERMINOLOGY |
|---|---|---|---|---|---|
| T or F<br>The traditional batting donut is not permissible in Little League.<br>True | The _____ usually has the best arm in the outfield.<br>Right fielder | Bill Hamilton is the only major leaguer player to score 200 runs in one season.<br>False - He scored 196 which is the closest anyone has gotten to 200. | The National League was founded in the year ____.<br>A. 1876<br>B. 1898<br>C. 1900<br>D. 1920 | A batter who hits a ball and reached base because of a fielder's error is credited with a(n) _____ rather than a base hit.<br>Hit on error | The ____ covers the most territory in the outfield.<br>Center fielder |

TABLE 2-continued

| "Challenge" Questions | | | | | |
|---|---|---|---|---|---|
| RULES | STRATEGIES | STATS | HISTORY | SITUATIONS | TERMINOLOGY |
| T or F<br>After the regular season is over, two more umpires "right" and "left" field are added during post season play.<br>True | T or F<br>Managers never keep players on the roster just because they are speedy, because of the limited roster.<br>False | Duane Kuiper didn't hit his first home run until his 1,000th time at bat.<br>False - 1,381 at bat. | T or F<br>After the War, (World War II), baseball game attendance in the major leagues soared.<br>True | A curve ball that breaks to the right and downward as it reaches the batter is thrown by a ____ pitcher.<br>Left-handed | Another name for a home run is ____.<br>A. Slammer<br>B. Whiff<br>C. Plunk<br>D. Tater |
| In the Major Leagues batters are not allowed to put pine tar anywhere above ____ inches from the handle of the bat.<br>A. 17<br>B. 15<br>C. 12<br>D. 20 | All good hitters will ____.<br>A. Keep their eyes on the ball.<br>B. Keep their front shoulders in.<br>C. Move their body correctly to generate power.<br>D. All of the above. | Jim Rice went into the record books for hitting into ____ double plays in a single season.<br>A. 42<br>B. 36<br>C. 28<br>D. 19 | T or F<br>Fleet Walker is really the first black player in the history of major league baseball.<br>True | T or F<br>There are at least 13 ways a pitcher can commit a balk.<br>True | A pitcher who is called to come in when his team is losing by a large amount is a(n) ____.<br>A. Loser<br>B. Clean-up man<br>C. Late comer<br>D. Mop-up man |
| In the major leagues, a player can re-enter a game _____ times once taken out.<br>Zero | The pitcher wants the hitter to keep guessing as to _____.<br>A. What type of pitch he will throw.<br>B. What movement the ball will take.<br>C. The speed at which the ball will be delivered and location.<br>D. All of the above. | The Florida Marlins won the World Series in 1997, which was only their ____ year of existence.<br>fifth | Mark McGuire hit his 500th career home run during an August 5, 1998 game against the _____.<br>A. New York Yankees<br>B. Detroit Tigers<br>C. San Diego Padres<br>D. Minnesota Twins | T or F<br>It is possible for a major league player to appear in say 100 games in a season without ever pitching or stepping up to the plate.<br>True - pinch runner | A play in which the ball and runner arrive virtually at the same time is known as a(n) _____.<br>Bang-bang play |

For example, as shown in the Tables, the regular and "challenge" questions can be further divided into categories depending on the type of question, level of play or the like. In addition, although the preferred embodiment of the invention has been discussed in reference to the sport of baseball, the inventor's board game can be equally adapted to simulate and educate players about other sports such as football, basketball and the like. Furthermore, it is to be realized that the dimensional relationships for the parts of the invention, including variations in size, materials, shape, form, function, and manner of operation, assembly and use and all equivalent relationships to those illustrated in the drawings and described in the specification are intended to be encompassed by the present invention.

FIG. 8 shows another embodiment of the invention wherein the board game of the preferred embodiment has been adapted to be played as a video or electronic computer game. FIG. 8 shows in general terms how such game might appear on a video or computer screen 100, wherein a first portion 110 of the screen 100 shows a depiction of a baseball stadium of field 112. Of course, illustrations of a die 114, scoreboard 116, as well as dugouts, players, umpire, (not shown) as well as fan noise, the sound of the ball being pitches and hit, and virtually any other desired feature adding to the attractiveness of the game can be electronically added. Players might also wish to choose teams which depict their favorite professional or college teams. A second or separate portion or screen can be used to show the regular and challenge question card decks.

The electronic version of the game would be played in essentially the same way as the board game version. A chance determining means such as a die would be "rolled" such as by clicking a mouse or pressing a button activating a probability program known in the art which would determine the results which come up. If the batting player rolled a "hit," the player would then try to answer a question from one of the regular question cards. This could be accomplished by several means, such as by clicking a mouse on the deck of regular question cards in the area 120, which would turn over or reveal one question and four possible answers. Once the regular question card is chosen, a full-size image 130 of the question might appear on the screen 100 such as shown in FIG. 9 so that the question is more visible or legible. The player will then be required to try to choose or identify the correct answer by clicking on or otherwise picking an answer; if the correct answer is chosen, a player piece would automatically be move to the designated base; if the question is answered incorrectly, an out would be recorded. If a player wished to play alone, it is also envisioned that such player could play against a computer generated opponent as is commonly used in other electronic games. Of course, the correct score, batter statistics and the like could all be updated automatically and kept by the computer. Thus, an electronic version of the game could be just as entertaining and educational as the board game version of the game. In addition, electronic versions of similar games but simulating a different sport or activity could also be easily created.

While the inventor has described in detail a preferred embodiment of the board 30 game as it might be played if simulating the game of baseball, the game could also be adapted to simulate other games or activities. For example, the game of football, could be simulated wherein two dice may be used with one indicating a run, pass, kick, etc. and the other indicating various numbers of yards to be advanced, while question cards drawn by the offensive side, if answered correctly, will allow the full advance, or challenge cards will allow a double advance.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A method of learning while playing a board game comprising the steps of:

operating a chance means to determine a player's move of a game piece on a game board, the game board having a generally planar top surface on which an area simulative of a field or court for playing said game is portrayed, if instructed by said chance means to advance a game piece a number of spaces in accordance with said chance means, first attempting to answer a question from a first set of playing cards wherein if said question is answered correctly, the game piece is advanced in accordance with said chance means, but if said question is answered incorrectly, the game piece is not advanced; and if the question from the first set of playing cards is answered correctly, at the option of the player, asking an opposing player a question from a second set of playing cards wherein if the question is answered incorrectly the player piece is advanced an additional space or spaces.

2. A method of playing a board game in accordance with claim 1 wherein if said opposing player answers the question correctly, the player's game piece remains in its original position.

3. A method of playing a board game in accordance with claim 1 wherein the game board has spaces arranged so that movements of the game pieces are simulative of a sport or activity.

4. A method of playing a board game in accordance with claim 3 wherein the sets of playing cards are divided so that questions asked from the first set of playing cards are in general more difficult than questions asked from the second set of playing cards.

5. A method of playing a board game in accordance with claim 1 wherein the sport or activity being simulated is baseball and the spaces of the game board are simulative of the bases in a typical baseball diamond.

6. A method of playing a board game in accordance with claim 5 wherein the sets of playing cards are divided so that questions asked from the first set of playing cards are in general more difficult than questions asked from the second set of playing cards.

7. A method of playing a board game in accordance with claim 1 wherein the game is played with a chance means comprising a six-sided die with each side containing indicia of typical situations which occur during play of the game being simulated.

8. A method of playing a board game in accordance with claim 1 wherein the sets of questions are designed to teach the players about the rules, terminology, strategy, situations, and history of the game being simulated.

9. A method of playing a board game in accordance with claim 1 wherein the number of times a player may ask a question from the second set of more difficult question playing cards is limited.

* * * * *